US005420618A

United States Patent [19]

Sekiya et al.

[11] Patent Number: 5,420,618

[45] Date of Patent: May 30, 1995

[54] INK JET RECORDING METHOD AND APPARATUS HAVING DROP SIZE CONTROL BY USING PLURAL CONTROL ELECTRODES

[75] Inventors: Takuro Sekiya; Mitsuru Shingyouchi, both of Yokoyama; Eiko Suzuki, Sagamihara; Masami Kadonaga, Yokohama, all of Japan

[73] Assignee: Ricoh Company, Ltd., Tokyo, Japan

[21] Appl. No.: 880,737

[22] Filed: May 8, 1992

[30] Foreign Application Priority Data

May 13, 1991 [JP] Japan ..... 3-137257

[51] Int. Cl.[6] ..... B41J 2/05

[52] U.S. Cl. ..... 347/9; 347/57; 347/61; 347/63

[58] Field of Search ..... 346/1.1, 140 R; 347/9, 347/10, 11, 56, 57, 61, 62, 63

[56] References Cited

U.S. PATENT DOCUMENTS

| | | | |
|---|---|---|---|
| 3,060,429 | 10/1962 | Winston | 347/55 X |
| 3,298,030 | 1/1967 | Lewis et al. | 347/74 |
| 3,416,153 | 12/1968 | Hertz et al. | 347/73 |
| 3,596,275 | 7/1971 | Sweet | 347/74 |
| 3,747,120 | 7/1973 | Stemme | 347/70 |
| 4,251,824 | 2/1981 | Hara et al. | 347/57 |
| 4,339,762 | 7/1982 | Shirato et al. | 347/62 |
| 4,686,544 | 8/1987 | Ikeda et al. | 347/64 |
| 4,740,796 | 4/1988 | Endo et al. | 347/56 |
| 4,866,460 | 9/1989 | Shiozaki | 347/58 |
| 5,121,143 | 6/1992 | Hayamizu | 347/63 |

FOREIGN PATENT DOCUMENTS

| | | |
|---|---|---|
| 54-51837 | 4/1979 | Japan . |
| 55-73568 | 6/1980 | Japan . |
| 55-73569 | 6/1980 | Japan . |
| 55-132259 | 10/1980 | Japan . |
| 61-118259 | 6/1986 | Japan . |
| 0223349 | 1/1990 | Japan . |

*Primary Examiner*—Benjamin R. Fuller
*Assistant Examiner*—John Barlow
*Attorney, Agent, or Firm*—Cooper & Dunham

[57] ABSTRACT

An ink jet recording apparatus is provided with an ink jet recording head which includes at least one nozzle for ejecting ink, a heating layer, and a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode. The ground electrode electrically connects to the heating layer within a region of the thermal energy action part, and the control electrodes electrically connects to the heating layer outside the region of the thermal energy action part.

14 Claims, 6 Drawing Sheets

INK JET RECORDING METHOD AND APPARATUS HAVING DROP SIZE CONTROL BY USING PLURAL CONTROL ELECTRODES

BACKGROUND OF THE INVENTION

The present invention generally relates to ink jet recording methods and apparatuses, and more particularly to an ink jet recording method which enables gradation recording and an ink jet recording apparatus which employs such an ink jet recording method.

Recently,. there is growing interest in non-impact recording methods because noise generated at the time of the recording is negligibly small according to these methods. Among such non-impact recording methods, the so-called ink jet recording method is an effective method because a high-speed recording is possible and the recording can be made on an ordinary paper without the need for a special fixing process. Various kinds of ink jet recording methods have been proposed in the past, and some have already been reduced to practice while others are still being modified.

The ink jet recording methods eject droplets of ink and adhere the droplets onto a recording medium such as paper. The ink jet recording methods can be categorized into several systems depending on the methods of generating the droplets of ink and the methods of controlling the ejecting direction of the droplets.

A first method is disclosed in a U.S. Pat. No. 3,060,429, for example. According to this first method, the droplets of ink are generated by electrostatic suction and the droplets are controlled by an electric field depending on a recording signal so that the droplets are selectively adhered on the recording medium. More particularly, the electric field is applied between a nozzle and an accelerating electrode, and the nozzle ejects uniformly charged droplets of ink. These droplets are ejected between x-y deflection electrodes which are electrically controlled depending on the recording signal, and the droplets are selectively adhered on the recording medium depending on the intensity change of the electric field.

A second method is disclosed in U.S. Pat. Nos. 3,596,275 and 3,298,030, for example. According to this second method, charge-controlled droplets of ink are generated by a continuous vibration generating method, and the droplets are ejected between deflection electrodes applied with a uniform electric field and adhered on the recording medium. More particularly, a recording head having a piezo vibration element and a nozzle is employed, and a charging electrode applied with a recording signal is arranged in front of an orifice of the nozzle at a predetermined distance from the orifice. An electric signal having a constant frequency is applied to the piezo vibration element so as to mechanically vibrate the piezo vibration element, and the droplets of ink are ejected via the orifice. The droplets which are ejected are charged by the charging electrode due to electrostatic induction, and the droplets are charged by an amount dependent on the recording signal. The charge-controlled droplets are deflected depending on the amount of charge as they are ejected between deflection electrodes which apply a uniform electric field, and only the droplets which carry the recording signal are adhered on the recording medium.

A third method is disclosed in a U.S. Pat. No. 3,416,153, for example. According to this third method, an electric field is applied between a nozzle and a ring-shaped charging electrode, and the droplets of ink are generated in the form of mist by the continuous vibration generating method. In other words, according to this third method, the mist state of the droplets is controlled by modulating the field intensity applied between the nozzle and the charging electrode depending on the recording signal, and the recording is made on the recording medium with gradation.

A fourth method is disclosed in a U.S. Pat. No. 3,747,120, for example. The operating principle of this fourth method differs completely from those of the first, second and third methods described above. In other words, the first through third methods electrically control the droplets of ink ejected from the nozzle, and the droplets carrying the recording signal are selectively adhered on the recording medium. But according to the fourth method, the droplets of ink are ejected from the nozzle depending on the recording signal. That is, the electric recording signal is applied to the piezo vibration element of the recording head which has the nozzle so as to convert the electric recording signal into the mechanical vibration of the piezo vibration element, and the droplets of ink are ejected from the nozzle depending on this mechanical vibration so as to adhere the droplets on the recording medium.

However, each of the four methods described above have problems to be solved, as will be described hereinafter.

According to the first through third methods, the droplets of ink are generated directly from electrical energy, and the deflection control of the droplets is made by the electric field. For this reason, the first method uses a simple construction, but a large voltage is required to generate small droplets of ink. In addition, the first method is unsuited for a high-speed recording because it is difficult to provide a multi-nozzle on the recording head.

As for the second method, the high-speed recording is possible because the multi-nozzle may be provided on the recording head. However, the construction needed to generate the droplets of ink becomes complex, and it is difficult to electrically control the small droplets. Furthermore, the so-called satellite dots are easily formed on the recording medium.

The third method can record a satisfactory image with gradation by forming a mist of the droplets of ink. But in this case, it is difficult to control the mist state, and smear is easily formed on the recording medium. Furthermore, it is difficult to provide the multi-nozzle on the recording head, and the third method is unsuited for carrying out the high-speed recording.

Compared to the first through third methods, the fourth method has a relatively large number of advantageous points. In other words, the fourth method uses a simple construction. In addition, since the droplets of ink are ejected from the nozzle in an on-demand manner, it is unnecessary to recover the droplets which are not used for the recording, unlike the first through third methods. Moreover, unlike the first and second methods, the fourth method does not require the use of a conductive ink, and the material and composition of the ink can be selected with a large degree of freedom. But on the other hand, it is difficult to form the recording head required by the fourth method. Furthermore, it is difficult to provide the multi-nozzle on the recording head because the downsizing of the piezo vibration element having a desired resonance frequency is extremely difficult. The fourth method is also unsuited for carrying out the high-speed recording because the droplets of ink are ejected by the mechanical energy, that is, the mechanical vibration of the piezo vibration element.

Therefore, there is a problem in that the first through fourth methods can only be used in applications where the disadvantages of each method can substantially be neglected.

An ink jet recording apparatus was previously proposed in a Japanese Laid-Open Patent Application No. 54-51837 to reduce the problems described above. According to this proposed ink jet recording apparatus, the ink within an ink chamber is heated so as to generate air bubbles and the pressure of the ink is increased. As a result, the ink is ejected from a fine capillary tube nozzle and transferred onto a recording medium such as paper. Using the operating principle of this proposed ink jet recording apparatus, various modifications have been made.

A Japanese Laid-Open Patent Application No. 2-23349 proposes one of such modifications. According to this modification, a thermal ink jet recording head ejects droplets of ink from a capillary tube region in response to an electrical signal. The thermal ink jet recording head is provided with a head resistor which generates heat in response to the electrical signal and is provided at a position such that the heat is applied within the capillary tube region. The head resistor includes a resistor region and a conductor region which surrounds the resistor region. At least a part of the conductor region is electrically connected to the resistor region. By providing the conductor region at the central part of the resistor region, the air bubbles are generated in a ring shape when a current pulse is applied, and a cool point is generated at the center of the head resistor. As a result, the air bubbles are destroyed into smaller air bubbles and the smaller air bubbles are distributed at random on the surface of the head resistor due to the shock of this destruction, thereby making it possible to minimize the damage caused by the cavitation of the head resistor.

The durability of the ink jet recording apparatus proposed in the Japanese Laid-Open Patent Application No. 54-51837 has also been improved recently and reduced to practice. However, the demand to more finely control the amount of ink ejection is increasing so that it is possible to obtain an even finer image quality. A Japanese Laid-Open Patent Application No. 55-132259 proposes one method of satisfying such a demand.

According to the method proposed in the Japanese Laid-Open Patent Application No. 55-132259, a sudden state transition is caused in the ink by the action of the thermal energy, and droplets of ink are ejected by the action based on this state transition so as to adhere the ink on the recording medium. More particularly, an ejection orifice for ejecting the ink in a predetermined direction is provided at a terminal end of a conduit, and a thermal action part is arranged to communicate with the ejection orifice and to effectively transmit the action force generated therein in the direction of the ejection orifice. This thermal action part is formed by at least two electric-to-heat converters capable of independently receiving signals, and a gradation recording is carried out by appropriately shifting the timings of the signals input to the electric-to-heat converters. As may be understood from the teaching in the Japanese Laid-Open Patent Application No. 55-132259, a control electrode and a ground (common) electrode are formed on the same plane. For this reason, there is a problem in that it is difficult to arrange the electrodes with a high density.

On the other hand, Japanese Laid-Open Patent Applications No. 55-73568 and No. 55-73569 propose selecting a predetermined number of heaters out of a plurality of heaters arranged in one conduit or, selecting one heater from a plurality of heaters having mutually different heat values, so as to vary the size of the air bubbles which are generated and to control the amount of ink which is ejected. However, the air bubbles generated in the thermal ink jet recording apparatus displays a binary behavior ("1" or "0"), that is, the ink is either ejected or not ejected. Therefore, the amount of ink which is ejected inevitably changes in steps, and a smooth change cannot be realized. For this reason, there is a problem in that it is difficult to make the recording with a high image quality.

SUMMARY OF THE INVENTION

Accordingly, it is a general object of the present invention to provide novel and useful ink jet recording method and apparatus in which the problems described above are eliminated.

Another and more specific object of the present invention is to provide an ink jet recording apparatus comprising an ink jet recording head which includes at least one nozzle for ejecting ink, a heating layer, and a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, where the ground electrode electrically connects to the heating layer within a region of the thermal energy action part, and the control electrodes electrically connects to the heating layer outside the region of the thermal energy action part. According to the ink jet recording apparatus of the present invention, it is possible to continuously vary the amount of ink which is ejected in an extremely smooth manner.

Still another object of the present invention is to provide an ink jet recording head comprising at least one nozzle for ejecting ink, a heating layer, a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, where the ground electrode electrically connects to the heating layer within a region of the thermal energy action part, and the control electrodes electrically connects to the heating layer outside the region of the thermal energy action part. According to the ink jet recording head of the present invention, the construction becomes simple compared to the conventional head having a plurality of thermal energy action parts with respect to one nozzle.

A further object of the present invention is to provide an ink jet recording method which uses an ink jet recording head including at least one nozzle for ejecting ink, a heating layer, a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, the ground electrode electrically connecting to the heating layer within a region of the thermal energy action part, the control electrodes electrically connecting to the heating layer outside the region of the thermal energy action part, where the ink jet recording method comprises the steps of (a) setting resistances between the ground electrode and the control electrodes mutually different, and (b) applying a voltage across the ground electrode and a selected one of the control electrodes depending on a level of a signal which describes information to be recorded. According to the ink jet recording method of the present invention, it is possible to continuously vary the amount of ink which is ejected in an extremely smooth manner.

Another object of the present invention is to provide an ink jet recording method which uses an ink jet recording head including at least one nozzle for ejecting ink, a heating layer, a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, the ground electrode electrically connecting to the heating layer within a region of the thermal energy action part, the control electrodes electrically connecting to the heating layer outside the region of the thermal energy action part, where the ink jet recording method comprises the steps of (a) selecting an arbitrary number of control electrodes depending on a level of a signal which describes information to be recorded, and (b) applying a voltage across the ground electrode and the selected arbitrary number of control electrodes. According to the ink jet recording method of the present invention, it is possible to continuously vary the amount of ink which is ejected in an extremely smooth manner.

Other objects and further features of the present invention will be apparent from the following detailed description when read in conjunction with the accompanying drawings.

DESCRIPTION OF THE PREFERRED EMBODIMENTS

Figure 1A:
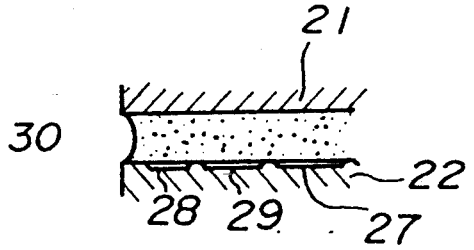
FIGS. 1A–1G (referred to collectively as FIG. 1 below) are diagrams for explaining the operation of a bubble ink jet head to which the present invention may be applied.
Figure 1B:
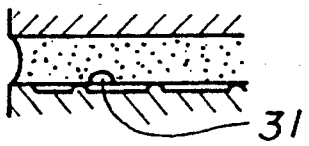
Figure 1C:
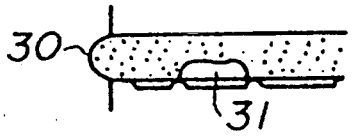
Figure 1D:
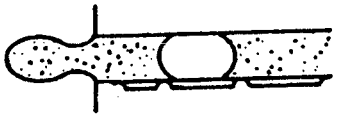
Figure 1E:
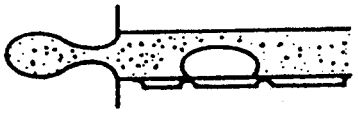
Figure 1F:
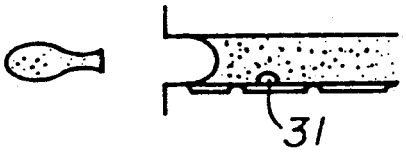
Figure 1G:
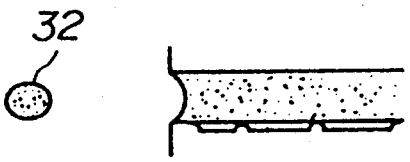
Figure 2:
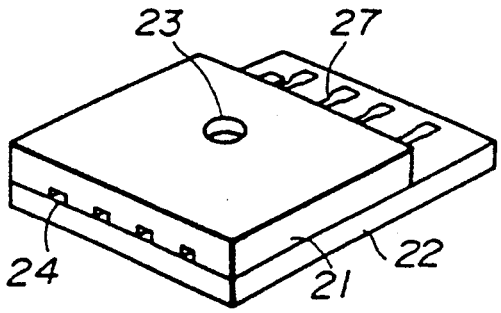
FIG. 2 is a perspective view showing the bubble ink jet head.
Figure 3:
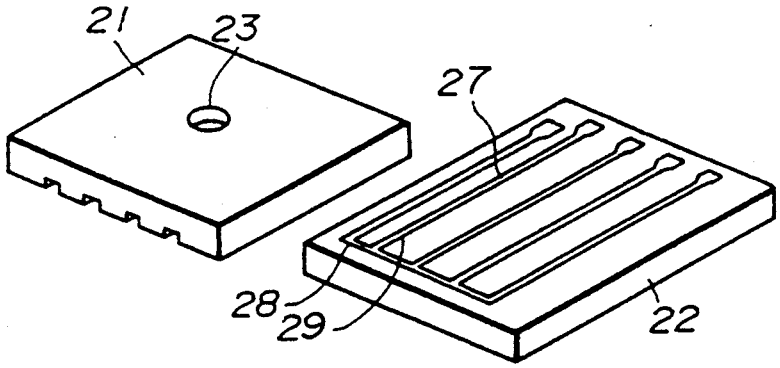
FIG. 3 is a perspective view showing a lid substrate and a heater substrate of the bubble ink jet head shown in FIG. 2 in a disassembled state.
Figure 4:
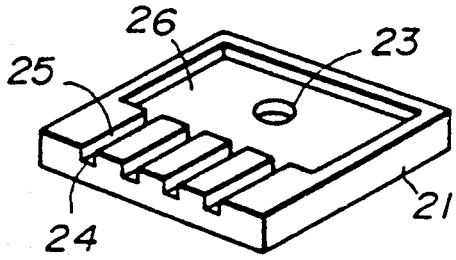
FIG. 4 is a perspective view showing the lid substrate viewed from the bottom in FIG. 3.
Figure 5A:
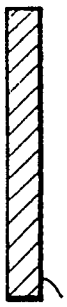
FIGS. 5A–5D (referred to collectively as FIG. 5 below) are diagrams for explaining a method of producing an embodiment of a heat energy action part of a head of an ink jet recording apparatus according to the present invention.
Figure 5B:
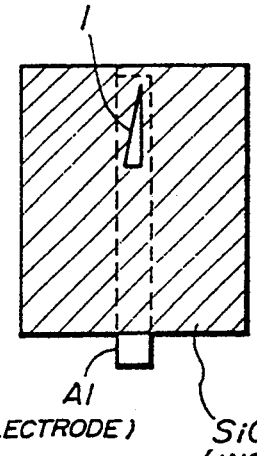
Figure 5C:
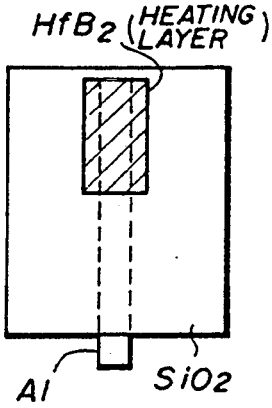
Figure 5D:
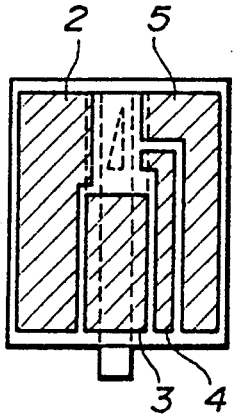
Figure 6A:
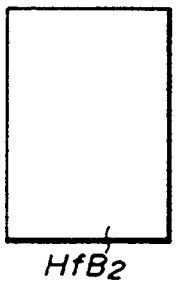
FIGS. 6A–6E (referred to collectively as FIG. 6 below) are diagrams for explaining a method of forming a heating layer and a control electrode.
Figure 6B:
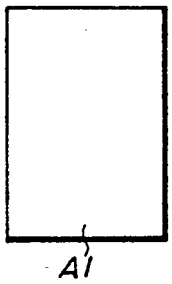
Figure 6C:
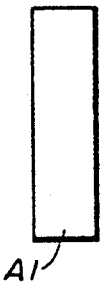
Figure 6D:
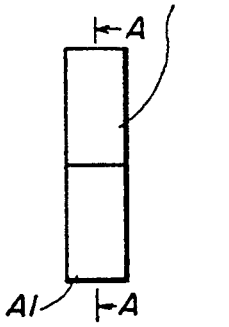
Figure 6E:
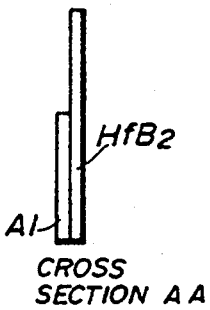
Figure 7A:
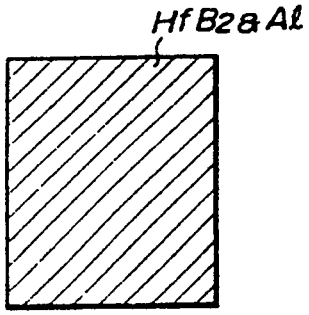
FIGS. 7A–7E (referred to collectively as FIG. 7 below) are diagrams for explaining a method of producing another embodiment of the heat energy action part of the head of the ink jet recording apparatus according to the present invention.
Figure 7B:
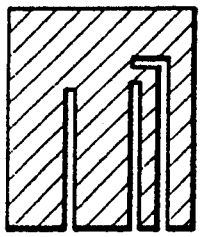
Figure 7C:
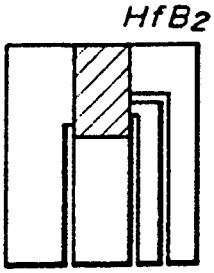
Figure 7D:
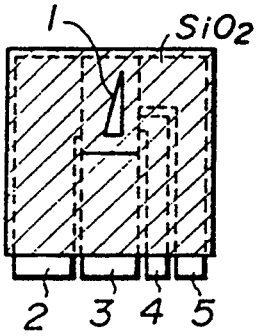
Figure 7E:
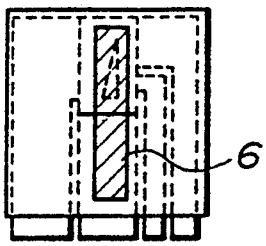

FIG. 1 is a diagram for explaining the operation of a bubble ink jet head to which the present invention may be applied, and FIG. 2 is a perspective view showing the bubble ink jet head. FIG. 3 is a perspective view showing a lid substrate and a heater substrate of the bubble ink jet head shown in FIG. 2 in a disassembled state, and FIG. 4 is a perspective view showing the lid substrate viewed from the bottom in FIG. 3. In FIGS. 1 through 4, the bubble ink jet head includes a lid substrate 21, a heater substrate 22, an ink inlet 23, an orifice 24, a conduit 25, a region 26 for forming an ink chamber, an independent electrode 27, a common electrode 28 and a heater 29. An air bubble 31 is formed in an ink 30, and this ink 30 is ejected in the form of a droplet 32.

First, a description will be given of the operation of the bubble ink jet head, by referring to FIG. 3.

In FIG. 1, (a) shows a stationary state in which the surface tension of the ink 30 at the orifice surface is balanced with the external pressure.

In FIG. 1, (b) shows a state in which the surface temperature of the heater 29 rises rapidly to a temperature at which the boiling phenomenon occurs in the adjacent ink layer and the ink 30 is studded with fine air bubbles 31.

In FIG. 1, (c) shows a state in which the rapidly heated adjacent ink layer instantaneously evaporates at the entire surface of the heater 29 to form a boiling film and the air bubbles 31 are grown. In this state, the pressure within the nozzle is raised by the amount by which the air bubbles 31 grow. For this reason, the surface tension at the orifice surface and the external pressure become unbalanced, and a column of the ink 30 starts to grow at the orifice 24.

In FIG. 1, (d) shows a state in which the air bubbles 31 are grown to a maximum and an amount of the ink 30 corresponding to the volume of the air bubbles 31 is pushed out from the orifice surface. In this state, no current is supplied to the heater 29 and the surface temperature of the heater 29 is about to fall. The volume of the air bubbles 31 reaches the maximum value at a time which is slightly delayed from the time when an electrical pulse is applied to the head.

In FIG. 1, (e) shows a state in which the air bubbles 31 are cooled by the ink 30 and the like and start to contract. The tip end part of the ink column continues to move to the left in FIG. 3 while maintaining the velocity at which the ink 30 is pushed out of the orifice 24. On the other hand, a constriction is formed in the ink column at the rear end part of the ink column because the pressure within the nozzle decreases due to the contraction of the air bubbles 31 and the ink flows backward into the nozzle from the orifice surface.

In FIG. 1, (f) shows a state in which the air bubbles 31 further contract and the ink 30 makes contact with the heater surface thereby further and rapidly cooling the heater surface. At the orifice surface, the meniscus is large because the external pressure becomes higher than the pressure within the nozzle, and the meniscus enters within the nozzle. The tip end part of the ink column becomes a droplet and is ejected towards the recording paper at a velocity of approximately 5 to 10 m/sec.

In FIG. 1, (g) shows a state in which the ink 30 is refilled to the orifice 24 by the capillary phenomena and the air bubbles 31 are completely eliminated. This state (g) corresponds to the process of returning to the initial state shown in (a).

In the present invention, the size of the air bubbles which are generated or the timing with which the plurality of air bubbles are generated is varied, depending on a level of a signal which describes information to be recorded, in the thermal ink jet recording apparatus which operates under the operating principle such as that described above.

A description will be given of a method of producing an embodiment of a thermal energy action part of a head of the ink jet recording apparatus according to the present invention, by referring to FIG. 5 which shows the characterizing structure of the present invention. In (a) through (d) of FIG. 5, only the pattern part which is formed at that process is indicated by the hatching. A contact hole is denoted by a reference numeral 1, and control electrodes are denoted by reference numerals 2 through 5.

When actually producing the thermal energy action part, it is of course not essential that the shape and the connection of the patterns (heating layer and electrode pattern) shown in FIG. 5 are employed.

In (a) of FIG. 5, a silicon wafer is subjected to a thermal oxidation to form a silicon dioxide (($SiO_2$) layer having a thickness of 1.5 μm as a heat storage layer. An aluminum (Al) layer having a thickness of 1 μm is formed on the $SiO_2$ layer as a ground electrode, and this Al layer is formed into a pattern shown by using photolithography and etching techniques.

In (b) of FIG. 5, a $SiO_2$ layer which is used as an insulator layer is formed to a thickness of 1.2 μm by a sputtering. A contact hole 1 is formed in this $SiO_2$ layer by using the photolithography and etching techniques, for making contact to the underlying Al layer (ground electrode). In this case, the contact hole 1 has a triangular shape.

In (c) of FIG. 5, a hafnium boride ($HfB_2$) layer which is used as a heating layer is formed to a thickness of 3000 Å by a sputtering. This $HfB_2$ layer is formed into a shape at a position by using the photolithography technique such that the $HfB_2$ layer makes contact with the underlying Al layer (ground electrode ) via the contact hole 1.

In (d) of FIG. 5, an Al layer which is used as a control electrode is formed to a thickness of 1 μm by a sputtering. This Al layer is formed into a pattern shown by the photolithograhpy and etching techniques. In this case, four control electrodes 2 through 5 are formed. These control electrodes 2 through 5 can be driven independently with respect to one heating layer.

Finally, although not shown in FIG. 5, a $SiO_2$ protecting layer is formed to a thickness of 1 μm by a sputtering, so as to protect the heating layer and the electrodes from corrosion caused by the ink. This $SiO_2$ protecting layer does not cover a region where a bonding pad is formed. In addition, a tantalum (Ta) layer which is used as a cavitation resistant protecting layer is formed to a thickness of 4000 Å by a sputtering in a vicinity of the heating layer. Furthermore, an electrode protecting layer is formed to a thickness of 1.2 μm at the electrode part. For example, this electrode protecting layer is made of Photonith manufactured by Toray, Japan. The pattern of each of the protecting layers can be appropriately controlled by the photolithography and etching techniques.

FIG. 6 is a diagram for explaining a method of forming the heating layer and the control electrode. As described above, FIG. 5 is a diagram for explaining the characterizing structure of the present invention, but the shape and process described in conjunction therewith are not necessarily the same, so as to simplify the description. FIG. 6 shows one example of the actual shape and process related to the heating layer and the control electrode.

When forming the control electrode 3 shown in FIG. 5, $HfB_2$ is sputtered on the entire surface as shown in (a) of FIG. 6, and Al is sputtered thereon in succession as shown in (b) of FIG. 6. Next, as shown in (c) of FIG. 6, a pattern made up of the band shaped $HfB_2$ layer and the Al layer stacked thereon is formed by the photolithography and etching techniques. Finally, as shown in (d) of FIG. 6, the $HfB_2$ layer which becomes the heating part is exposed using the photolithography and etching techniques. In this case, the cross section becomes as shown in (e) of FIG. 6.

A description will be given of a method of producing another embodiment of the thermal energy action part of the head of the ink jet recording apparatus according to the present invention, by referring to FIG. 7 which also shows the characterizing structure of the present invention. In (a) through (d) of FIG. 7, only the pattern part which is formed at that process is indicated by the hatching.

When actually producing the thermal energy action part, it is of course not essential that the shape and the connection of the patterns (heating layer and electrode pattern) shown in FIG. 7 are employed.

In (a) of FIG. 7, a silicon wafer is subjected to a thermal oxidation to form a $SiO_2$ layer having a thickness of 1.5 μm as a heat storage layer. A $HfB_2$ layer is sputtered on the $SiO_2$ layer to a thickness of 3000 Å as a heating layer, and an Al layer is then sputtered to a thickness of 1 μm as an electrode.

In (b) of FIG. 7, the $HfB_2$ and Al layers are patterned as shown using the photolithography and etching techniques.

In (c) of FIG. 7, the Al layer is partially removed by the photolithography and etching techniques so as to expose the heating layer.

In (d) of FIG. 7, a $SiO_2$ layer is sputtered as an insulator layer, and by using the photolithography and etching techniques, a contact hole 1 is formed in a region of this $SiO_2$ layer where the heating layer exists underneath. In this case, the contact hole 1 has a triangular shape.

In (e) of FIG. 7, an Al layer is sputtered to a thickness of 1 μm and is then patterned by the photolithography and etching techniques so as to form a ground electrode 6. This ground electrode 6 makes contact with the heating layer via the contact hole 1.

Finally, although not shown in FIG. 7, a $SiO_2$ protecting layer is formed to a thickness of 1 μm by a sputtering, so as to protect the heating layer and the electrodes from corrosion caused by the ink. This $SiO_2$ protecting layer does not cover a region where a bonding pad is formed. In addition, a tantalum (Ta) layer which is used as a cavitation resistant protecting layer is formed to a thickness of 4000 Å by a sputtering in a vicinity of the heating layer. Furthermore, an electrode protecting layer is formed to a thickness of 1.2 μm at the electrode part. For example, this electrode protecting layer is made of Photonith manufactured by Toray, Japan. The pattern of each of the protecting layers can be appropriately controlled by the photolithography and etching techniques.

The positional relationship of the ground electrode and the control electrode is reversed between the embodiments shown in FIGS. 5 and 7. Otherwise, the two embodiments are the same in that the heating layer and the ground electrode are stacked via the insulator layer.

Figure 8:
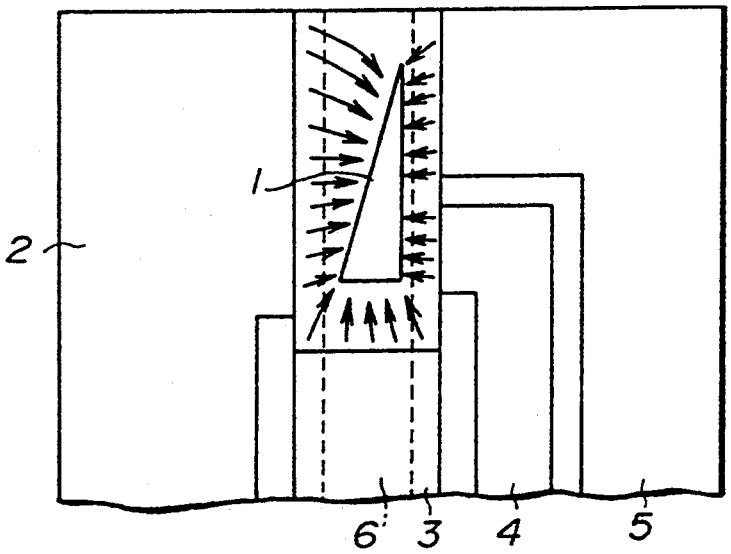
FIG. 8 is a diagram for explaining the operation of the ink jet recording apparatus according to the present invention.

FIG. 8 is a diagram for explaining the operation of the ink jet recording apparatus according to the present invention. In FIG. 8, only the heating layer, the ground electrode and the control electrode are shown, and the illustration of the insulator layer and the protecting layers is omitted so as to facilitate the understanding of the operating principle of the present invention. In addition, the positional relationships of the layers at the connecting parts of the patterns is also omitted in FIG. 8.

The ground electrode 6 and the heating layer are connected via the triangular contact hole 1. When a driving pulse is input to each of the control electrodes 2 through 5, a current flows as indicated by the arrows in FIG. 8.

Figure 9A:
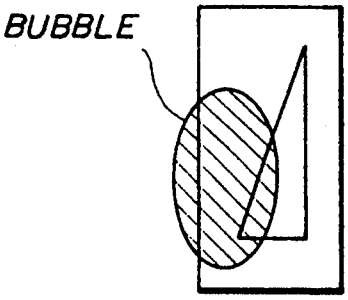
FIGS. 9A and 9B (referred to collectively as FIG. 9 below) are diagrams for explaining an air bubble which is generated when a driving pulse is input to a control electrode.
Figure 9B:
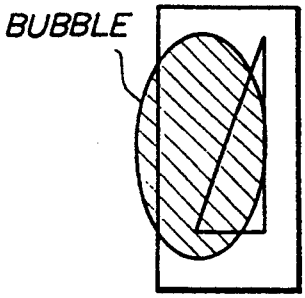

First, attention is given to the control electrode 2. A boundary line which is formed by the connecting part between the control electrode 2 and the heating layer is not parallel to a boundary line which is formed by the connecting part between the ground electrode 6 and the heating layer and closest to the control electrode 2. Accordingly, when the driving pulse is input to the control electrode 2, a heat gradient is generated on the heating part and the air bubble is first generated at the lower region as shown in (a) of FIG. 9. Next, if the driving pulse voltage is increased, the size of the air bubble becomes larger and the air bubble reaches the upper region as shown in (b) of FIG. 9. In other words, the size of the air bubble which is generated can be varied by varying the input energy.

Figure 10:
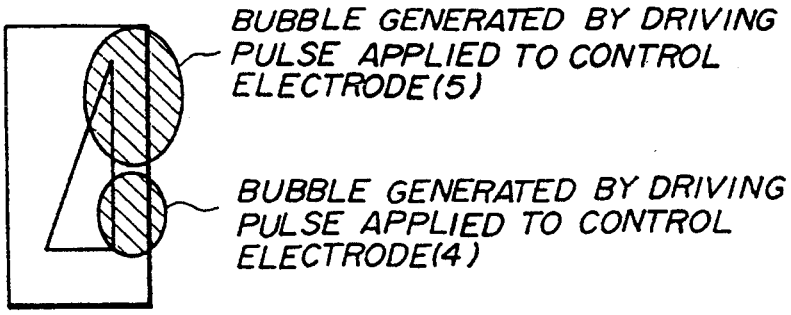
FIG. 10 is a diagram for explaining an air bubble which is generated when another control electrode is used.

Next, attention is given to the control electrodes 4 and 5. In this case, the widths of the control electrode 4 and 5 which connect to the heating layer differ. For this reason, if the same driving pulse voltage is input to the control electrodes 4 and 5, the heat values of the respective parts of the heating layer become different, and the sizes of the air bubbles generated thereby also differ. In the case shown in FIG. 8, the control electrode 5 is wider and generates a larger air bubble as shown in FIG. 10.

Similarly, when attention is given to the control electrodes 3 and 4, the widths of the control electrode 3 and 4 which connect to the heating layer differ. However, if the width of the patterns of these control electrodes 3 and 4 were the same, the distance from the connecting part of the control electrode 3 and the heating layer to a boundary line which is formed by the connecting part of the ground electrode 6 and the heating layer closest to the control electrode 3 is different from the distance from the connecting part of the control electrode 4 and the heating layer to a boundary line which is formed by the connecting part of the ground electrode 6 and the heating layer closest to the control electrode 4. For this reason, the resistances of the control electrodes 3 and 4 become different, and similarly, the sizes of the air bubbles which are generated also become different.

Figure 11A:
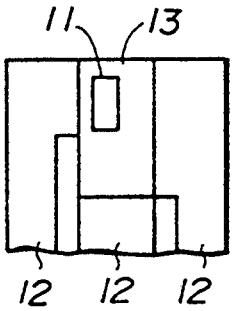
FIGS. 11A–11C (referred to collectively as FIG. 11 below) show pattern of the thermal energy action part.
Figure 11B:
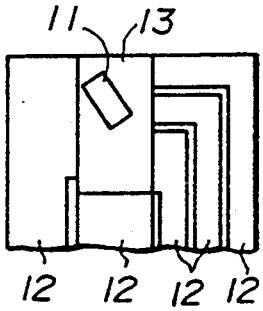
Figure 11C:
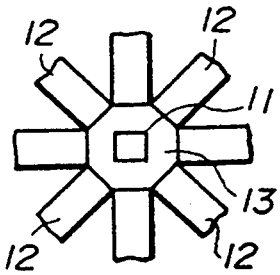

The operating principle of the present invention was described above for the patterns shown in FIG. 5, but the present invention is of course not limited to the patterns shown in FIG. 5. FIG. 11 shows another embodiment of the patterns. In FIG. 11, the reference numerals 11, 12 and 13 respectively denote a contact hole, a control electrode and a heating layer.

The patterns shown in FIGS. 5, 7 and (a) and (b) of FIG. 11 are suited for use in the so-called edge shooter type thermal ink jet recording head which ejects the ink in a direction parallel to the heating surface. On the other hand, the pattern shown in (c) of FIG. 11 is suited for use in the so-called side shooter type thermal ink jet recording head which ejects the ink in a direction perpendicular to the heating surface.

As described above, it may be readily seen that the present invention enables the size of the air bubble to be varied on the heating layer which connects to each of the control electrodes.

Next, a description will be given of a preferable application of the present invention. In a most simple application, one control electrode is selected depending on the level of a signal which describes the information to be recorded. Because the size of the air bubble can be varied on the heating layer which connects to each control electrode, the amount of ink which is ejected can easily be varied by appropriately selecting the control electrodes.

Even if it is assumed that the pattern is such that the sizes of the air bubbles generated at each of the control electrodes are the same, one or mode control electrodes can be driven simultaneously depending on the level of the signal which describes the information to be recorded, so as to vary the number of the air bubbles generated on the heating layer. A plurality of air bubbles may be combined into one air bubble, and in this case, the volume of the air bubble is varied and not the number. In any case, the amount of ink which is ejected can be varied in this manner. In this case, if the pattern is such that the size of the air bubble generated at each control electrode is variable, a plurality of control electrodes may be appropriately selected and there are various variations to this selection. As a result, it is possible to continuously vary the amount of ink which is ejected in an extremely smooth manner.

Figure 12A:
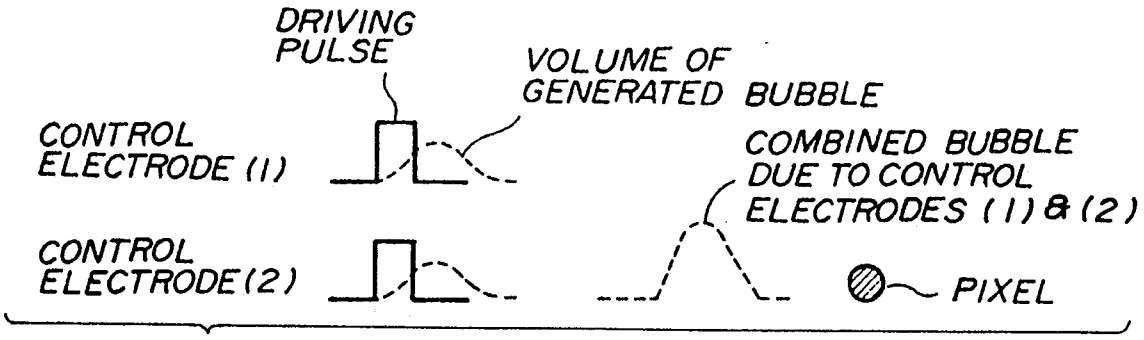
FIGS. 12A and 12B are diagrams for explaining a method of varying the amount of ink which is ejected by driving two control electrodes.
Figure 12B:
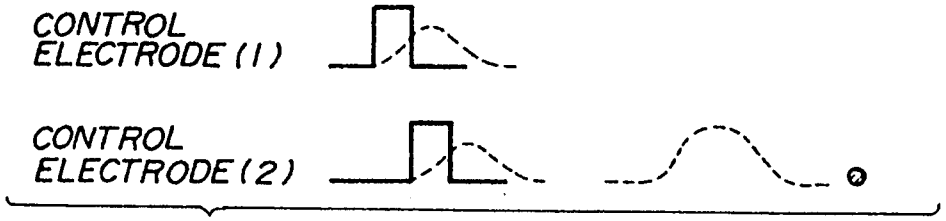

In another application, the timing with which the current is applied to each of the control electrodes may be varied, so as to generate the air bubbles simultaneously or with a time difference. As a result, it is possible to vary the amount of ink which is ejected. FIGS. 12A and 12B are diagrams for explaining the method of varying the amount of ink which is ejected by driving two control electrodes. FIG. 12A shows a case where the driving pulse is simultaneously applied to the two control electrodes. In this case, the two air bubbles which are generated are combined to form a large air bubble. As a result, the amount of ink which is ejected increases and a large pixel is recorded. If the two air bubbles are mutually separated, the two air bubbles are not combined and the two air bubbles are generated as independent air bubbles but at the same time. On the other hand, FIG. 12B shows a case where the driving pulse is applied to the two control electrodes with a time difference. Unlike the case shown in FIG. 12A, the two air bubbles reach the maximum size at different times, and thus, the combined air bubble does not becomes as large as in the case shown in FIG. 12A. Accordingly, the amount of ink which is ejected is smaller and the diameter of the pixel which is recorded is smaller compared to the case shown in FIG. 12A.

In a first embodiment of the ink jet recording apparatus according to the present invention, the head having the structure shown in FIG. 1 is used. This head has the thermal energy action part shown in FIG. 5. The experiment was conducted by applying the driving pulse to each control electrode, where the ejection nozzle has the size of 55 μm×50 μm and the thermal energy action part (region of the heating layer) has the size of 80 μm×200 μm. The contact hole which connects the heating layer and the ground electrode has the triangular shape as shown in FIG. 5, and the size of this contract hole is 15 μm×100 μm×101 μm. The distance from the ejection nozzle formed at approximately the center of the heating layer to the closest thermal energy action part is 180 μm.

The ink used is the ink of "Think Jet" manufactured by Hewlett Packard of the U.S.A. The recording was made on a "Mat Coat Paper NM" manufactured by Mitsubishi Seishi of Japan. The same driving pulse was applied to each of the control electrodes, the voltage being 28 V and the pulse width being 6 μsec. The resistance between the ground electrode 6 and the control electrodes 2 through 5 was 60.7 Ohms for the control electrode 2, 81.2 Ohms for the control electrode 3, 100.3 Ohms for the control electrode 4, and 70.7 Ohms for the control electrode 5. The following Table 1 shows the evaluation results of the diameters of the pixels which are recorded under each of the listed conditions. The diameter of the pixel shown in the Table 1 is an average value of fifty pixels.

TABLE 1

| Case No. | Condition | Pixel Diameter (μm) |
|---|---|---|
| 1. | Driving pulse applied only to electrode 2 | 120.6 |
| 2. | Driving pulse applied only to electrode 3 | 100.5 |
| 3. | Driving pulse applied only to electrode 4 | 96.1 |
| 4. | Driving pulse applied only to electrode 5 | 110.2 |
| 5. | Driving pulse applied to electrodes 2 & 3 at same time | 170.1 |
| 6. | Driving pulse applied to electrodes 2 & 4 at same time | 160.8 |
| 7. | Driving pulse applied to electrodes 3 & 4 at same time | 131.3 |
| 8. | Driving pulse applied to electrodes 2 to 5 at same time | 222.5 |
| 9. | Driving pulse applied to electrode 3 3 μsec after applying driving pulse to electrode 2 | 159.1 |
| 10. | Driving pulse applied to electrode 3 5 μsec after applying driving pulse to electrode 2 | 146.3 |

TABLE 1-continued

| Case No. | Condition | Pixel Diameter (μm) |
|---|---|---|
| 11. | Driving pulse applied to electrode 3 10 μsec after applying driving pulse to electrode 2 | 127.7 |
| 12. | Driving pulse applied to electrode 4 3 μsec after applying driving pulse to electrodes 2 & 3 | 201.5 |
| 13. | Driving pulse applied to electrode 4 5 μsec after applying driving pulse to electrodes 2 & 3 | 186.2 |
| 14. | Driving pulse applied to electrode 4 10 μsec after applying driving pulse to electrodes 2 & 3 | 175.0 |

Therefore, it is possible to easily continuously vary the diameter of the pixel which is recorded in an extremely smooth manner by independently applying the driving pulse to each of the control electrodes, simultaneously applying the driving pulse to combinations of the control electrodes or, varying the timings with which the driving pulse is applied to each of the control electrodes. Hence, it is possible to record the image on the recording medium (for example, paper) with a high image quality.

In a second embodiment of the ink jet recording apparatus according to the present invention, only the control electrode 2 is used and the recording is carried out by gradually varying the driving pulse (input energy). The following Table 2 shows the evaluation results of the diameters of the pixels which are recorded under each of the listed conditions.

TABLE 2

| Driving Voltage (V) | Pulse Width (μsec) | Pixel Diameter (μm) |
|---|---|---|
| 25 | 6 | 95.5 |
| 26 | 6 | 101.1 |
| 27 | 6 | 112.3 |
| 28 | 6 | 120.6 |
| 29 | 6 | 140.4 |

Further, the present invention is not limited to these embodiments, but various variations and modifications may be made without departing from the scope of the present invention.

What is claimed is:

1. An ink jet recording apparatus comprising:

an ink jet recording head which includes at least one nozzle for ejecting ink, a heating layer, and a ground electrode and a plurality of control electrodes electrically connected to the heating layer;

a circuit means for applying a voltage across at least one pair of the ground electrode and one of said control electrodes; and a thermal energy action part, formed in the heating layer in correspondence with the nozzle, for heating the ink and causing a state transition so as to elect the ink from the nozzle when voltage is applied by said circuit means, said ground electrode being electrically connected to the heating layer within a region of said thermal energy action part, said control electrodes being electrically connected to the heating layer outside the region of said thermal energy action part;

which further comprises an insulator layer formed on the heating layer and a contact hole formed in the insulator layer, said ground electrode being electrically connected to the thermal energy action part via the contact hole.

2. The ink jet recording apparatus as claimed in claim 1, wherein an outer boundary line of said thermal energy action part and an outer boundary line of said contact hole are not parallel to each other.

3. An ink jet recording apparatus comprising:

an ink jet recording head which includes at least one nozzle for ejecting ink, a heating layer, and a ground electrode and a plurality of control electrodes electrically connected to the heating layer;

a circuit means for applying a voltage across at least one pair of the ground electrode and one of said control electrodes; and a thermal energy action part, formed in the heating layer in correspondence with the nozzle, for heating the ink and causing a state transition so as to eject the ink from the nozzle when voltage is applied by said circuit means, said ground electrode being electrically connected to the heating layer within a region of said thermal energy action part, said control electrodes being electrically connected to the heating layer outside the region of said thermal energy action part;

wherein resistances between the ground electrode and the control electrodes are mutually different.

4. The ink jet recording apparatus as claimed in claim 3, wherein distances between the ground electrode and each of the control electrodes are mutually different.

5. The ink jet recording apparatus as claimed in claim 3, wherein widths of each of the control electrodes are mutually different in a region in which the control electrode electrically connect to said thermal energy action part.

6. An ink jet recording head comprising:

at least one nozzle for ejecting ink;

a heating layer;

a ground electrode and a plurality of control electrodes electrically connected to the heating layer;

a circuit means for applying a voltage across at least one pair of the ground electrode and one of said control electrodes;

a thermal energy action part, formed in the heating layer in correspondence with the nozzle, for heating the ink and causing a state transition so as to eject the ink from the nozzle when said voltage is applied by said circuit means;

said ground electrode being electrically connected to the heating layer within a region of said thermal energy action part, said control electrodes being electrically connected to the heating layer outside the region of said thermal energy action part; and an insulator layer formed on the heating layer and a contact hole formed in the insulator layer, said ground electrode being electrically connected to the thermal energy action part via the contact hole;

wherein an outer boundary line of said thermal energy action part and an outer boundary line of said contact hole are not parallel to each other.

7. An ink jet recording head comprising:

at least one nozzle for ejecting ink;

a heating layer;

a ground electrode and a plurality of control electrodes electrically connected to the heating layer;

a circuit means for applying a voltage across at least one pair of the ground electrode and one of said control electrodes; and a thermal energy action part, formed in the heating layer in correspondence with the nozzle, for heating the ink and causing a state transition so as to eject the ink from the nozzle when said voltage is applied by said circuit means, said ground electrode being electrically connected to the heating layer within a region of said thermal energy action part, said control electrodes being electrically connected to the heating layer outside the region of said thermal energy action part;

wherein resistances between the ground electrode and the control electrodes are mutually different.

8. The ink jet recording head as claimed in claim 7, wherein distances between the ground electrode and each of the control electrodes are mutually different.

9. The ink jet recording head as claimed in claim 7, wherein widths of each of the control electrodes are mutually different in a region in which the control electrode electrically connect to said thermal energy action part.

10. An ink jet recording method which uses an ink jet recording head including at least one nozzle for ejecting an ink, a heating layer, a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, said ground electrode being electrically connected to the heating layer within a region of the thermal energy action part, said control electrodes being electrically connected to the heating layer outside the region of the thermal energy action part, said ink jet recording method comprising the steps of:

(a) setting resistances between the ground electrode and the control electrodes mutually different; and (b) applying a voltage across the ground electrode and a selected one of the control electrodes depending on a level of a signal which describes information to be recorded.

11. The ink jet recording method as claimed in claim 10, wherein said applying step variably selects one of the control electrodes so that a diameter of a pixel which is recorded on a recording medium by the ejected ink is continuously variable.

12. An ink jet recording method which uses an ink jet recording head including at least one nozzle for ejecting ink, a heating layer, a ground electrode and a plurality of control electrodes electrically connected to the heating layer, and a thermal energy action part, formed in the heating layer in correspondence with the nozzle, for heating the ink and causing a state transition so as to eject the ink from the nozzle when a voltage is applied across at least one pair of the ground electrode and the control electrode, said ground electrode being electrically connected to the heating layer within a region of the thermal energy action part, said control electrodes being electrically connected to the heating layer outside the region of the thermal energy action part, said ink jet recording method comprising the steps of:

(a) selecting an arbitrary number of control electrodes depending on a level of a signal which describes information to be recorded; and (b) applying a voltage across the ground electrode and the selected arbitrary number of control electrodes.

13. The ink jet recording method as claimed in claim 12, wherein said applying step applies the voltage across the ground electrode and the selected arbitrary number of control electrodes with a time difference among the control electrodes.

14. The ink jet recording method as claimed in claim 12, wherein the selecting step variably selects a number of control electrodes so that a diameter of a pixel which is recorded on a recording medium by the ejected ink is continuously variable.

* * * * *